United States Patent [19]

Horton

[11] Patent Number: 4,468,157

[45] Date of Patent: Aug. 28, 1984

[54] TENSION-LEG OFF SHORE PLATFORM

[75] Inventor: Edward E. Horton, Rancho Palos Verdes, Calif.

[73] Assignee: Global Marine, Inc., Los Angeles, Calif.

[21] Appl. No.: 374,240

[22] Filed: May 3, 1982

Related U.S. Application Data

[63] Continuation-in-part of Ser. No. 146,363, May 2, 1980, abandoned.

[51] Int. Cl.[3] ..... E02B 17/08; E02D 5/74; E02D 21/00

[52] U.S. Cl. ..... 405/224; 405/200; 405/203; 114/265

[58] Field of Search ..... 405/196, 197, 200, 202, 405/205, 224, 203; 114/264–266

[56] References Cited

U.S. PATENT DOCUMENTS

| | | | |
|---|---|---|---|
| 1,829,304 | 10/1931 | Schroeder | 405/224 X |
| 2,346,391 | 4/1944 | Pitou et al. | 405/200 X |
| 2,960,833 | 11/1960 | Hayward | 405/200 |
| 3,017,934 | 1/1962 | Rhodes et al. | 175/7 |
| 3,154,039 | 10/1964 | Knapp | 114/0.5 |
| 3,196,958 | 7/1965 | Travers et al. | 175/7 |
| 3,648,638 | 3/1972 | Blenkarn | 114/0.5 D |
| 3,653,219 | 4/1972 | Mott | 61/46.5 |
| 3,719,048 | 3/1973 | Arne | 61/46.5 |
| 3,780,685 | 12/1973 | Horton | 114/0.5 D |
| 3,934,528 | 1/1976 | Horton et al. | 114/0.5 D |
| 3,996,755 | 12/1976 | Kalinowski | 61/86 |
| 4,117,690 | 10/1978 | Besse | 405/227 |
| 4,117,691 | 10/1978 | Spray | 405/205 |
| 4,180,349 | 12/1979 | Van Bilderbeek | 405/224 |
| 4,226,555 | 10/1980 | Bourne et al. | 405/224 |
| 4,297,965 | 11/1981 | Horton et al. | 114/265 |

FOREIGN PATENT DOCUMENTS

| | | | |
|---|---|---|---|
| 1337601 | 11/1973 | United Kingdom | 114/265 |

*Primary Examiner*—Cornelius J. Husar
*Assistant Examiner*—Nancy J. Stodola
*Attorney, Agent, or Firm*—Christie, Parker & Hale

[57] ABSTRACT

A tension-leg offshore platform comprises a positively buoyant, floating upper unit in which an operations platform is supported above an ocean surface by a plurality of spaced vertical columns defining buoyancy chambers. The lower ends of the columns are connected to the ocean floor by a corresponding plurality of tension-leg assemblies. Each tension-leg assembly is comprised of a plurality of positively buoyant tubular members having their lower ends connected securely against upward movement to the ocean floor. The tubular members are of substantially equal length less than the pertinent water depth by an amount adequate to cause their upper ends to be located below the area of significant surface wave action yet substantially above the ocean floor. A separate flexible tension member for each tubular member connects the lower ends of the columns to the upper ends of the corresponding tubular members. The positive buoyancy of the platform upper unit, as connected to the tubular members, is greater than the buoyancy it would have if floated at the same draft free of connection to the tubular members.

12 Claims, 7 Drawing Figures

Fig. 3
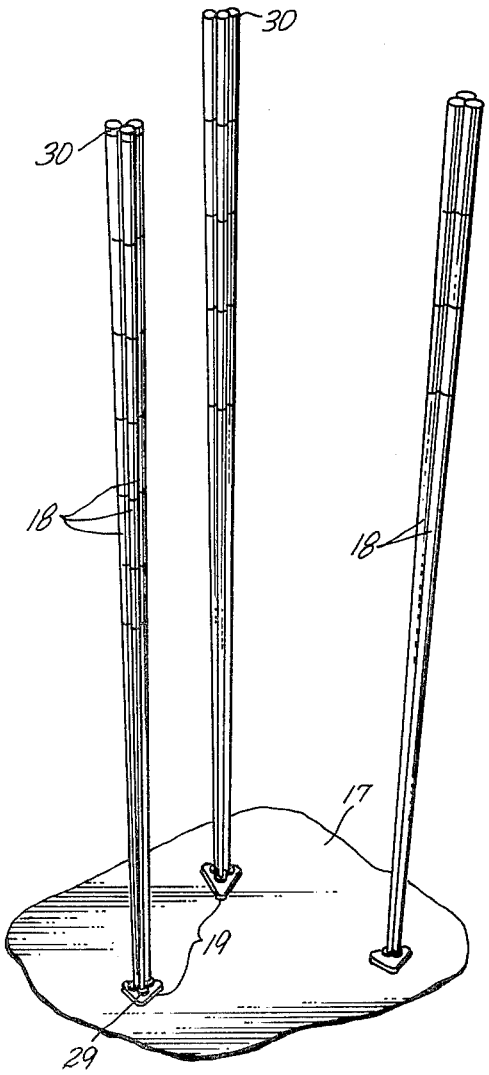
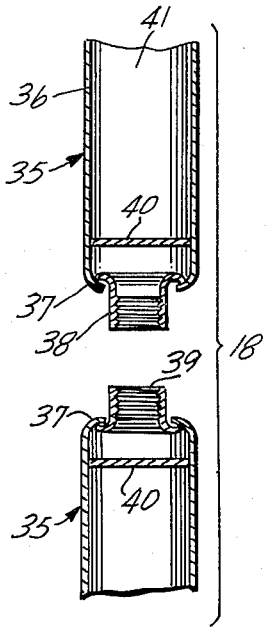
Fig. 7

11
12
13
14
14
14
15
10
21
30
22
18
16
19
20
19
23
29
17
19

TENSION-LEG OFF SHORE PLATFORM

CROSS REFERENCE TO RELATED APPLICATIONS

This application is a continuation-in-part of Ser. No. 146,363, filed May 2, 1980, now abandoned for "Tension Leg Offshore Platform".

FIELD OF THE INVENTION

This invention pertains to offshore platforms useful in the development of subsea oil and gas wells and for the production of oil and gas from such wells. More particularly, it pertains to such platforms of the tension-leg type.

BACKGROUND OF THE INVENTION

Review of the Prior Art

Tension-leg offshore platforms are known. Such platforms are useful in the drilling of offshore oil and gas wells, but are most commonly used as facilities for the production of oil and gas wells drilled at subsea locations by use of other equipment and techniques. Tension-leg platforms are useful in waters ranging from shallow (300 foot depths or less) to deep (1000 foot depths or more), but are used to best advantage in deep waters where the economics of rigid towers built on the sea floor become unattractive.

Tension-leg platforms are connected to the seafloor. They have operations areas located above the ocean surface. The legs which connect the surface portions of the platform to the sea floor are loaded in tension by positive buoyancy of the surface portions of the tower; this is in contrast to rigid towers in which the supporting legs are loaded compressively as columns.

Tension-leg platforms described to date are one-of-a-kind structures; such structures are known to be very costly. Also, such structures do not have components which are rapidly reusable in other places after drilling and production activities at their initial locations have been completed. Previously described tension-leg platforms entail expensive installation equipment located either on the platform itself or on other special purpose support and installation vessels. A need exists for tension-leg platforms having reusable components and which can be installed with minimal use of costly equipment.

U.S. Pat. No. 4,297,965 discloses a tension leg structure comprising a single pipe structure anchored to the ocean floor and connected to a floating platform by a plurality of wire ropes. Such wire ropes are spaced apart by centers which are at least ten feet apart.

An aspect of this invention is the recognition and solution of a previously unrecognized problem inherent in prior tension leg structures for tension leg platforms. The problem is present in the leg structure described in U.S. Pat. No. 4,297,965. When installed, the wire ropes are equally tensioned. During operation, however, currents and wave action tend to deflect the platform laterally away from a position centered over the anchor. Such lateral shifting of the platform can approach 10% of the water depth. When the platform moves off center, the distance between the top of the pipe and the platform changes for each wire rope so that the distances become generally unequal. Consequently one wire rope will absorb most or all of the tension while the remaining ropes in the set will tend to become slack. Such uneven tensioning increases wire rope fatigue and must reduce the useful operating life of the tension leg assembly. Stated differently, when a tension leg structure comprises a single pipe connected to a platform by a group of parallel spaced wire ropes, one of the ropes will almost always be effectively shorter than its counterparts and the cables will be unevenly loaded.

There is need for a tension leg structure which is not afflicted by this problem of uneven loading of cables.

SUMMARY OF THE INVENTION

This invention addresses the needs identified above. This invention provides an improved tension-leg offshore platform having a surface component which can be used, over its useful life, at different offshore locations. The surface component can be a semi-submersible platform of existing structure, if desired. The invention also provides an improved tension leg structure for such a platform. Substantial aspects of the installation of the platform can be performed by use of the same equipment used to drill subsea wells to be produced from the installed platform, thus avoiding the need for expensive special purpose equipment.

Generally speaking, this invention provides apparatus arranged for assembly to define a tension-leg offshore platform. The apparatus comprises an adjustably buoyant upper unit which is adapted to float on an ocean surface. The upper unit includes an operations platform which is supported above the water surface on a support structure which includes a plurality of laterally spaced, substantially vertical hollow columns. The columns include ballast tanks which are selectively floodable for varying the positive buoyancy of the upper unit. A corresponding plurality of tension-leg assemblies are provided. Each tension-leg assembly is adapted to be connected in tension between the lower end of a corresponding column of the upper unit on the one hand, and the ocean floor, on the other hand. Each tension leg assembly includes a plurality of positively buoyant tubular members, each of which is adapted at a lower end thereof to be connected to anchor means secured to the ocean floor. Each tubular member is adapted to extend upwardly to an upper end disposed a selected distance below the ocean floor, the selected distance being common to the upper ends of all of the tubular members. For each tubular member, a corresponding flexible tension member is adapted to be connected between the tubular member and the lower end of the corresponding upper unit column.

DESCRIPTION OF THE ACCOMPANYING DRAWINGS

The above-mentioned and other features of this invention are more fully set forth in the following detailed description of the presently preferred embodiment of the invention, which description is presented with reference to the accompanying drawings, wherein:

FIG. 3 is a perspective view showing the structure of a portion of the tension-leg platform upon completion of the installation stage illustrated in FIG. 2;

FIG. 7 is a fragmentary cross-sectional elevation view showing certain details of the components of the tubular portion of the platform tension legs.

DESCRIPTION OF THE ILLUSTRATED EMBODIMENT

Figure 6:
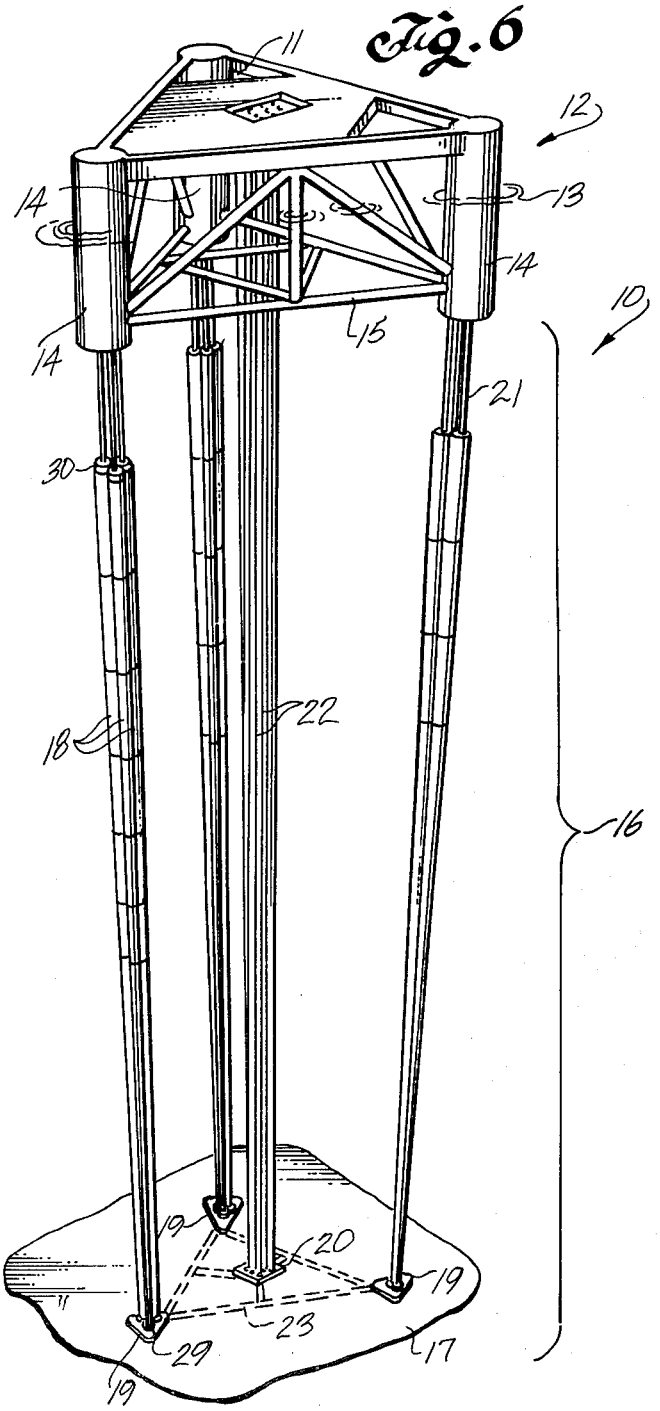
FIG. 6 is a perspective view showing the completed tension-leg platform.

FIG. 6 is a perspective view of a tension-leg platform 10 according to this invention as installed in association with a plurality of subsea hydrocarbons wells from which oil or gas is being produced to a suitable production facility, not shown, carried on an operations platform 11 in an upper unit 12 of platform 10. The operations platform is located above water surface 13.

The upper unit 12 of tension-leg platform 10 includes a plurality of large diameter, hollow, vertically oriented columns 14 which are disposed in a predetermined pattern relative to each other. The columns are interconnected by suitable structural framework 15 as desired. Upper unit 12 is positively buoyant. As shown in FIG. 6, the upper unit can be an existing semi-submersible platform such as is presently used in offshore drilling or hydrocarbons production facilities.

Further components of platform 10 are a plurality of tension-leg assemblies 16. Preferably, there are the same number of tension-leg assemblies in platform 10 as there are principal columns 14 in upper unit 12. Tension leg assemblies 16 are connected in tension between the lower end of a corresponding column 14 and sea floor 17. Each tension-leg assembly is composed of a plurality of positively buoyant tubular members 18 which are connected to suitable anchor means 19 at their lower ends and which have their upper ends 30 disposed, without structural interconnection between them, in a common plane located a selected distance below ocean surface 13. The common plane in which the upper ends of the tubular members of each tension leg assembly are disposed preferably is common to the upper ends of the tubular members of all of the tension-leg assemblies. Each tension-leg assembly 16 is further comprised of flexible tension means 21 which preferably are wire rope cables, but which may be chains if desired. The flexible tension means are connected between the upper ends of the tubular members in each tension-leg assembly and the lower end of the corresponding column 14 so that there is an individual cable associated with each tubular member.

The anchor means 19 to which the lower ends of tubular members 18 are connected are disposed on ocean floor 17 in a pattern which corresponds to the pattern according to which columns 14 are arranged in upper unit 12 of the tension-leg platform. Where platform 10 is to be used for the purposes of producing oil or gas from subsea wells, as is shown in FIG. 6, the tension-leg anchor means 19 are disposed at spaced locations circumferentially about a submerged wellhead assembly 20 on the ocean floor with which are associated a plurality of oil or gas wells. The oil or gas wells are connected from wellhead assembly 20 to the operations area of platform 10 via a plurality of hydrocarbons conductor riser pipes 22.

Tension-leg platform 10 may be installed at a desired location at sea either before or after completion of development drilling of a plurality of subsea oil or gas wells. If the developmental drilling operations pertinent to the subsea wells are to be carried out from the upper unit of tension-leg platform 10, then the subsea well head assembly 20 and substantial portions of the several anchor means 19 may be landed on ocean floor 17 as an interconnected group of assemblies; this situation is represented by the broken lines 23 of FIG. 6. In this instance, the overall structure landed on the sea floor defines a template for the drilling of the subsea wells, as well as a template for the drilling of drilled-in anchors for tension leg assemblies 16. On the other hand, if tension leg platform 10 is to be used as an offshore production facility for producing subsea oil or gas from subsea wells as to which the developmental drilling operations have been completed, then anchor templates 19 may be landed separately upon the ocean floor at spaced locations relative to the previously installed wellhead assembly 20, in the manner shown in solid lines in FIG. 6.

Figures 1, 2, 4, 5:
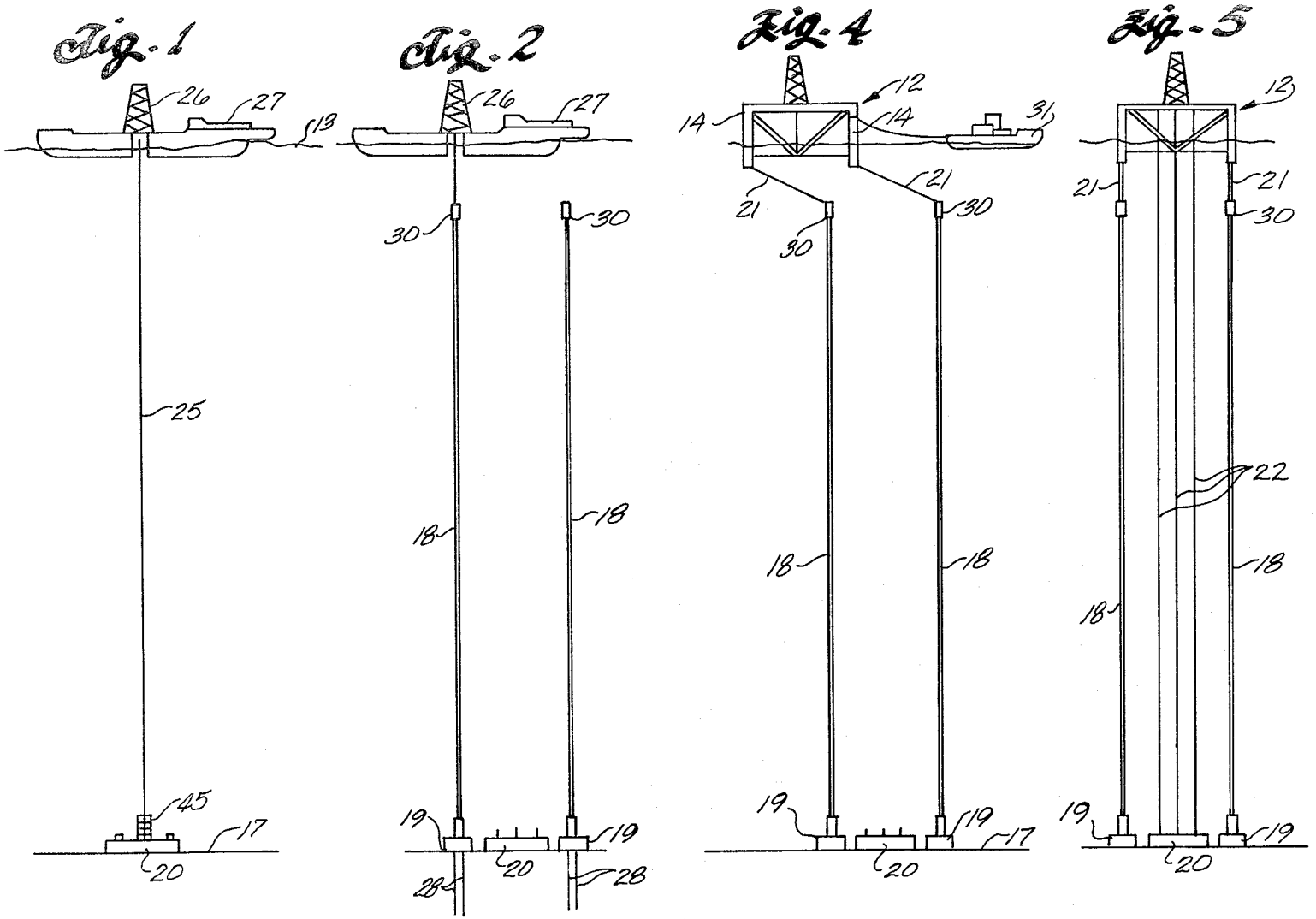
FIG. 1 is an elevation view illustrating an initial stage in the installation of the tension-leg platform.
FIG. 2 is an elevation view illustrating a subsequent early stage in the installation of the tension-leg platform.
FIG. 4 is an elevation view showing a step in the connection of the platform upper unit to the submerged platform structure illustrated in FIG. 3.
FIG. 5 is an elevation view showing the completed tension-leg platform.

The procedures involved in the installation of tension-leg platform 10, and the equipment useful in carrying out those procedures, are illustrated in FIGS. 1–5. FIG. 1 shows the drilling of a well in ocean floor 17 through wellhead assembly 20, and through a blowout preventer assembly 45 positioned on the wellhead assembly, by means of a drill string 25 suspended from a drilling rig 26 carried on a dynamically positioned offshore drilling platform such as drillship 27. By "dynamically positioned" is meant a floating drilling platform which is able to maintain a desired position on the ocean surface, within appropriate lateral limits, without reliance upon a physical connection to the sea floor. As each well is drilled to the desired depth below the ocean floor, the well is temporarily shut in at the wellhead assembly using existing equipment and techniques. Upon completion of development drilling of all desired wells, the drillship is then used to secure to the ocean floor the anchors for the tension-leg assemblies, and to assemble and install the tubular members of the tension-leg assemblies.

If not previously set in place on the ocean floor, the drilling templates 19 for the tension-leg anchors are set in place by the drillship at desired locations on the ocean floor as described above. Each template 19 defines a separate hole through it in association with each tubular member of the corresponding tension-leg assembly. Using the drillship and its drillstring 25, the same number of holes are drilled through each anchor drilling template 19 as there are tubular members 18 to be associated with that template. Each hole is drilled into the ocean floor sufficiently deeply to encounter a stable geologic formation below the ocean floor. Suitable anchor piles 28, see FIG. 2, are disposed in each of the holes drilled through the anchor template and the piles are cemented into place using conventional techniques. Preferably, all of the anchor piles associated with platform 10 are drilled in and cemented in place in one stage of the platform installation procedure; however, it is within the scope of this invention that, after cementing of the anchor piles for a given anchor template 19, the tubular members 18 for that template may be assembled and connected to that template before commencing the anchor pile installation procedure at another anchor template for platform 10.

As shown in FIG. 2, after each tension-leg assembly anchor template 19 has been securely affixed to the ocean floor by piles 28, each of the several tubular members 18 for a corresponding tension-leg assembly 16 is assembled at the drillship and lowered into connection of its lower end with the corresponding anchor pile. The connection of each tubular member 18 to the anchor pile is accomplished via a fleximeric connection 29 (see FIG. 6). The fleximeric connection is effective to hold the tubular member against substantial upward force applied to it, but permits and affords pivotal motion of the tubular member relative to the anchor pile.

All of the tubular members of the several tension-leg assemblies 16 are assembled and connected to the respective subsea anchor means as described above. When all of these tubular members have been connected to the sea floor, they have upper ends 30 which are disposed in a common plane a selected distance, say, 200 feet or so below water surface 13. This partially installed condition of tension-leg platform 10 is shown in greater detail in FIG. 3.

After the stage of the installation of platform 10 illustrated in FIG. 3 has been completed, the positively buoyant floating upper unit 12 of the platform is floated into the vicinity. Preferably this is done by the use of one or more tugboats 31. Flexible tension members 21 are connected between the lower ends of columns 14 and the upper ends of the corresponding group of tubular members 18; there is a separate flexible tension member associated with each tubular member. This may be done conveniently in the manner illustrated in FIG. 4 in which a suitable number of wire rope cables 21 are fed downwardly through suitable fairleads or other guides at the lower ends of columns 14, from suitable winches (not shown) carried on the platform upper unit. The lower ends of these paid-out wire rope cables are connected to the upper ends of the corresponding groups of tubular members 18, as by the use of divers. The winches are operated to take in the paid-out cables to assit tugboat 31 in moving the floating platform upper unit into precise position vertically above the upper ends of tubular members 18.

When the upper unit 12 has assumed its proper position relative to the tension-leg tubular members, the flexible tension members 21 are pulled taut to a predetermined level of tension between the tubular members and the lower ends of the columns and are then locked securely in place within the structure of the platform upper unit. Then, suitable buoyancy chambers, preferably defined within the hollow columns of the platform upper unit, are emptied of ballast water to cause the positive buoyancy of the upper unit to increase to an amount greater than that which would produce that draft of the upper unit. The positive buoyancy of the upper unit in excess of that buoyancy corresponding to the actual draft of the upper unit results in the upper unit applying an upwardly directed load to the flexible tension members and the tubular tension members. This load thus places the tension-leg assemblies in tension over their entire length, which tension acts on the upper unit as a downwardly directed force holding the upper unit at its desired place relative to the ocean floor. The tension-leg platform installation procedure is then complete. The platform can then be used, following connection of suitable hydrocarbons conductor riser pipes 22 to the several submerged wells at wellhead assembly 20, to produce appropriate hydrocarbons from those wells.

The tubular members, of which a plurality are provided in each tension-leg assembly 16, are defined by a plurality of serially connected tubular sections 35, adjacent ends of which are shown in FIG. 7. Each tubular member section 35 has a cylindrical tubular body 36. Bodies 36 may be 60 feet in length and, in the presently preferred embodiment of the tension-leg platform, are made of steel tubing having a diameter of 28 inches and a wall thickness of $\frac{3}{4}$ inch.

The upper and lower ends of each body 35 are rolled or swedged inwardly, as at 37, in cooperation with one or the other of either a female threaded connector member 38 or a male threaded connector member 39. Connector members 38 and 39 are configured to mate with each other to secure adjacent sections 35 securely together in coaxial end-to-end relation. The connector members preferably are welded to the adjacent section bodies. The adjacent inwardly curved ends 37 of the adjacent bodies bear upon each other when connector members 38 and 39 are interengaged. Also, as shown in FIG. 7, a watertight bulkhead 40 is secured, as by welding, across the interior of each body 36 adjacent the upper and lower ends of each section 35. Bulkheads 40 cooperate with the inner walls of each body to define a sealed buoyancy chamber 41 within each section of the tubular members.

Preferably each tubular member 18 is defined to have an axial tensile capacity sufficient to carry all of the upwardly directed load applied to each tension-leg assembly 16. A plurality, say three, of tubular tension members are provided in each tension-leg assembly to provide a redundant tension-leg assembly sufficient, in the event of failure of any one of the tubular members, to withstand the upwardly directed load applied to that tension-leg assembly. Similarly, it is preferred that a separate flexible tension member, wire rope or chain, of tensile capacity equal to or greater than each tubular member be connected between the upper end of each tubular member and the lower end of the corresponding column of upper unit 12.

It will be apparent from the foregoing description that each tubular tension member is positively buoyant. Thus, upon connection of the lower end of each tubular member 18 to its corresponding anchor means, the tubular member stands upright on the ocean floor without reliance upon guy wires or surface buoys.

It is an advantage of the present tension-leg platform that the only major piece of equipment involved in installing the tension-leg platform is a conventional floating drilling platform, such as a dynamically positioned drillship. Such equipment may be used both to drill the development wells associated with a particular offshore location and then to install the tension-leg platform from which those wells will be produced. The upper unit of the tension-leg platform can be provided as a conventional semi-submersible platform of which there are many now in existence. Also, if circumstances should arise which indicate that operations at a desired offshore location be discontinued, perhaps temporarily to be resumed at a later date, the upper unit of the tension-leg platform may be moved to another location where it can be put to use productively. The positively buoyant tubular members can remain in place without serving as a hazard to surface navigation where they remain ready to be reconnected to the same or a different platform upper unit at a later date.

The tension-leg platform described above and the procedures pertinent to its installation can be carried out economically and with dispatch. This invention therefor makes it possible to use tension-leg platforms in deep water in association with subsea oil or gas fields which would otherwise be left undeveloped because of marginal economic attractiveness.

The presently preferred tension-leg platform described above is useful in water depths in the range of from 400 to 1200 feet. This platform can be used in the presence of surface waves having a height of 48 feet and a period of 13 seconds, and in the presence of ocean currents having a velocity of 5 feet per second at the surface and 6 feet per second at the sea floor. The platform is designed to withstand wind velocities of 106 miles per hour.

There are several advantages realized by connecting a separate flexible tension member 21 between the upper end of each tubular member 18 and the lower end of the corresponding column 12, and by having the tubular members in each leg assembly unconnected to the other tubular members in the assembly. The individual tubular members and flexible tension members comprising each tension leg subassembly can absorb tension independently of each other and absorb substantially the same level of tension as the tension leg platform is deflected off center by wave or current action. The individual cables in a subassembly assume a configuration resembling a parallelogram for any deflection or position of the platform and hence are always under substantially uniform tension. Accordingly the cables never need experience extreme stress levels from unequal platform pipe distances induced by ordinary platform deflection.

Since the cables experience a lower level of cyclic stress than do the corresponding cables in the structure disclosed in U.S. Pat. No. 4,297,965, the cables experience substantially lower fatigue events and their useful life is increased substantially.

Another way of viewing the structure of this invention is that a separate tubular member 18 is provided for each flexible tension member 21. This provision allows the flexible tension members to absorb tension independently of each other while retaining a substantially uniform tension in the tension leg subassemblies.

This invention has been described above with reference to a presently preferred embodiment of the invention. This description has been presented by way of example and illustration in compliance with applicable requirements, rather than as a catalog exhaustive of all forms which the structures and procedures of this invention may take. Accordingly, the foregoing description should be interpreted consistently with, and not by way of limitation upon, the spirit of the following claims.

What is claimed is:

1. Apparatus arranged for assembly to define a tension-leg offshore platform comprising an adjustably buoyant upper unit adapted to float on an ocean surface with a characteristic maximum draft, the upper unit including an operations platform supported above the water surface on a support structure which includes a plurality of laterally spaced substantially vertical hollow columns which include ballast tanks selectively floodable for varying the positive buoyancy of the upper unit, a corresponding plurality of tension leg assemblies each connectible in tension between the lower end of a corresponding column and the ocean floor, each tension leg assembly comprising:

a plurality of positively buoyant tubular members each connectible at a lower end thereof to anchor means secured to the ocean floor and to extend upwardly to an upper end disposed a selected distance below the ocean surface greater than the maximum draft of the upper unit and common to the upper ends of all of the tubular members, for each such tubular member, a corresponding flexible tension member connectible between the upper end of the tubular member and the lower end of the corresponding column, and means for connecting the lower end of each tension leg assembly to anchor means secured to the ocean floor and for connecting each flexible tension member between each corresponding tubular member and the column member corresponding to the tension leg assembly of which the the corresponding tubular member is a part.

2. Apparatus according to claim 1 wherein the anchor means are piles adapted to be disposed in the ocean floor.

3. Apparatus according to claim 1 wherein each tubular member is composed of a plurality of serially connected tubular sections defining at each end thereof a coupling component connectible to a mating coupling component carried by an adjacent section, each section including a bulkhead across the interior thereof adjacent each coupling component and sealed airtight to the interior of the section.

4. Apparatus according to claim 3 wherein each coupling component is a component of a threaded connection.

5. Apparatus according to claim 1 including a connector engageable between the lower end of each tubular member and the anchor means, each connector being arranged to hold the tubular member against upward axial motion relative to the anchor means while affording and accommodating pivotal motion of the tubular member relative to the anchor means.

6. Apparatus according to claim 1 wherein the flexible tension members are comprised of wire rope.

7. A method for installing a tension-leg platform at a selected site on the surface of an ocean and for securing the platform to the ocean floor, comprising the steps of:

a. providing a positively buoyant platform upper unit which has a characteristic maximum draft and which includes an operations platform supported on the upper ends of a plurality of laterally spaced substantially vertical columns of substantial cross-sectional area which define therein selectively floodable and purgeable buoyancy chambers and which are disposed in a selected pattern, b. establishing on the ocean floor below the selected site a plurality of locations corresponding in number and pattern to the number and pattern of the columns, c. drilling into the ocean floor at each location at least one hole to a depth determined with regard to the nature of the ocean floor geology, d. placing and securing in each hole an elongate anchor member, thus to provide anchor means at each location, e. connecting to the anchor means at each location the lower end of a plurality of elongate, positively buoyant tubular tension members of substantially equal length less than the water depth at the selected site by an amount greater than the maximum draft of the upper unit, f. floating the platform upper unit to the site over the upper ends of the tubular members, g. adjusting the state of flooding of the buoyancy chambers to establish a selected draft of the upper unit, h. for each such tubular member, connecting flexible tension means between the upper end of the member and the lower end of a column corresponding to the location associated with the tubular member, and i. increasing the positive buoyancy of the upper unit to establish a selected tension level in the several flexible tension means and tubular tension members.

8. The method according to claim 7 wherein the step of establishing the locations includes the further step of disposing on the ocean floor template means including features defining the locations.

9. The method according to claim 8 wherein the step of drilling the holes includes drilling the holes through the template means.

10. The method according to claim 7 wherein the locations are established around a subsea well which is to be connected to the platform.

11. Hydrocarbons, both raw and refined, produced from a subsea hydrocarbons source by use of apparatus according to claim 1.

12. Hydrocarbons, both raw and refined, produced from a subsea hydrocarbons source via a platform installed by practice of the method according to claim 7.

* * * * *